US006932685B2

(12) United States Patent
Saitoh

(10) Patent No.: US 6,932,685 B2
(45) Date of Patent: Aug. 23, 2005

(54) VERTICAL TYPE OF DOUBLE DISC SURFACE GRINDING MACHINE FOR A BRAKE DISC

(75) Inventor: Akiyoshi Saitoh, Ikeda (JP)

(73) Assignee: Daisho Seiki Corporation, Ikeda (JP)

( * ) Notice: Subject to any disclaimer, the term of this patent is extended or adjusted under 35 U.S.C. 154(b) by 280 days.

(21) Appl. No.: 10/438,926

(22) Filed: May 16, 2003

(65) Prior Publication Data

US 2004/0014407 A1 Jan. 22, 2004

(30) Foreign Application Priority Data

Jul. 18, 2002 (JP) ..... P2002-209803

(51) Int. Cl.[7] ..... B24B 7/17
(52) U.S. Cl. ..... 451/269; 451/332
(58) Field of Search ..... 451/63, 202, 268, 451/269, 332

(56) References Cited

U.S. PATENT DOCUMENTS 4,760,669 A * 8/1988 Maccaferri et al. ..... 451/268
5,133,155 A * 7/1992 Schwar ..... 451/269
6,501,636 B1 * 12/2002 Savas et al. ..... 361/234
6,726,525 B1 * 4/2004 Kato et al. ..... 451/5

FOREIGN PATENT DOCUMENTS

JP 61-152359 7/1996
JP 10-217080 8/1998

* cited by examiner

*Primary Examiner*—Jacob K. Ackun, Jr.
(74) *Attorney, Agent, or Firm*—Crowell & Morning LLP

(57) ABSTRACT

A vertical type of double disc surface grinding machine of the present invention comprises a clamp device which can clamps and holds a work like a brake disc at a correct clamping position under a stable state even when a configuration of a work upper surface is complicated. This machine is equipped with a pair of upper and lower grinding wheels, a work holding jig which is self rotatable, and said clamp device. The clamp device is equipped with a clamp unit freely rotatable through a bearing onto a clamp rod of an elevator actuator. The clamp unit is equipped with a steel ball contacting with a central concave portion of a work upper surface.

3 Claims, 3 Drawing Sheets

VERTICAL TYPE OF DOUBLE DISC SURFACE GRINDING MACHINE FOR A BRAKE DISC

BACKGROUND OF THE INVENTION

1. Technical Field of the Invention

The present invention relates to a vertical type of double disc surface grinding machine which simultaneously grinds upper and lower end surfaces of a work like a brake disc of a vehicle held by a work holding jig by means of a pair of upper and lower grinding wheels. More particularly, it relates to an improvement in a clamp device for said grinding machine which grinds the work rotated by the work holding jig.

2. Prior Art

Conventionally, the clamp device for clamping the work to the self rotatable work holding jig has been equipped with a clamp metal such as a clamp claw or a clamp arm in a manner as vertically movable, so that the work has been secured to a specified position of the work holding jig by pushing the clamp metal from upside against a proper position of a work upper surface.

Especially, respect to a work which is a rotating body such as a disc brake for automobile and which has a wide ground surface and provided with a specified rigidity so as no to be deflected even when it is held at its center; a center position of the work is clamped to the work holding jig and the work is self rotated together with the work holding jig so that an outer peripheral portion of the work is inserted in between the grinding wheels.

PROBLEMS OF THE PRIOR ART TO BE RESOLVED

In case where the work is ground while being rotated by the work holding jig, it is difficult to hold the work at a correct holding position under a stable state and to always keep a grinding accuracy when a configuration of work upper surface is complicated or an area to be clamped is small.

OBJECTS OF THE INVENTION

An object of the present invention is to provide a vertical type of double disc surface grinding machine which can clamp and hold a work at its correct clamp position under stable state even when a configuration of work upper surface is complicated or an area to be clamped is small.

SUMMARY OF THE INVENTION

A vertical type of double disc surface grinding machine of the present invention comprises a work holding jig including a self-rotating mechanism and a clamp device for clamping a work W from upper side against the work holding jig, in which the clamp device is equipped with a clamp unit freely rotatable around a self rotating axis center of the work holding unit through a bearing onto an elevator mechanism of an elevator actuator; i.e. a clamp rod elevated by a cylinder, and the clamp unit is equipped with a steel ball contacting with a central concave portion of work upper surface.

According to the above-mentioned structure, even in case of the work having the complicated configuration of upper surface or the small area to be clamped, the work can be positioned correctly within a reference receiving surface which contacts with the work W to support it and can be clamped under stable state, as compared with the clamp device equipped with the clamp metal such as the conventional clamp claw; thereby a grinding accuracy can be kept stable.

Since the clamp unit is fitted to the elevator member (clamp rod) rotatably around the rotating axis center of the work holding jig, there is no possibility of occurrence of slippage between the steel ball and the work during the grinding work so that the steel ball is scarcely worn out.

When the steel ball is so inserted in a ball retaining cylinder as to be protruding downward and pressed from above by a conical receiving recessed surface of a ball cap attached to the ball retaining cylinder in a detachable manner, maintenance procedures such as assembly and replacement of the steel ball will become easy and the steel ball itself can be cheaply available in a form of goods on the market.

When a stop member (stop pin) which engages with a part of the work W to restrict a rotating motion of the work W relative to the work holding jig is installed on the upper surface of the work holding jig, the rotating motion of the work holding jig can be restricted relative to the work holding jig during the grinding operation, so that the grinding accuracy can be improved still more.

DETAILED DESCRIPTION OF THE PREFERRED EMBODIMENTS

Figure 1:
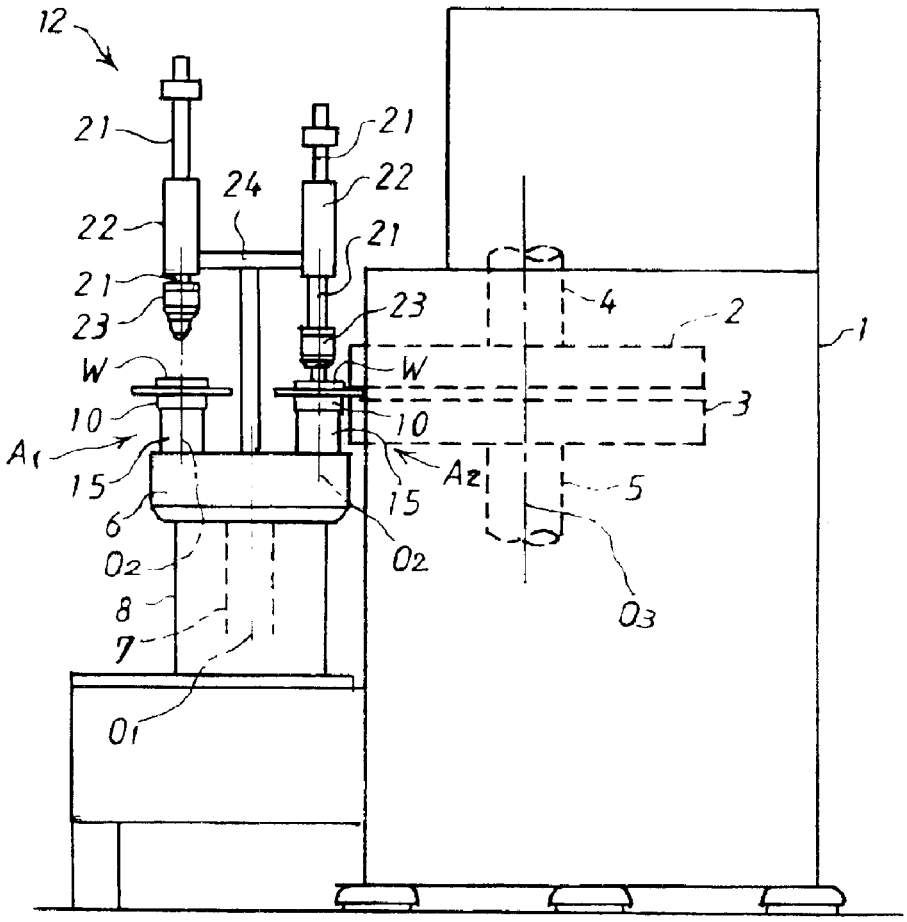
FIG. 1 is a side view of a vertical type of double disc surface grinding machine to which the the present invention is applied.

FIG. 1 is the side view of the vertical type of double disc surface grinding machine to which the present invention is applied. A pair of upper and lower opposing grinding wheels 2 & 3 are housed in a body case 1, and the upper and lower grinding wheels 2 & 3 are secured to upper and lower grinding wheel shafts 4 & 5 disposed on the same perpendicular axis center O3, respectively. The both grinding wheel shafts 4 & 5 are so constructed as to be movable in vertical direction by elevator mechanisms respectively, and so connected and linked to a power transmission mechanism that these shafts are rotated in reverse directions respectively.

An index table 6 for supplying works is secured to an upper end of a vertical table drive shaft 7, and this table drive shaft 7 is supported to a cylindrical support case 8 rotatably around a table rotating axis center O1 through a bearing, and connected and linked to a drive motor through a not-shown transmission mechanism.

On the index table 6, there installed a pair of work holding jigs 10 and clamp devices 12 for clamping works W on respective work holding jigs 10 from upside.

The both work holding jigs 10 are disposed each other around the table axis center O1 with a phase difference of 180°, and supported to a cylindrical jig support case 15 in such a manner as movable around a self-rotating center O2. By a half turn of the index table 6, a position change becomes possible between a grinding-wheel-side grinding position A2 for grinding works and an opposing side detaching position A1 for loading and unloading works.

The clamp device 12 is composed of a pair of cylinders 22 having clamp rods 21 extensible in lower side and clamp units 23 fitted to lower ends of the clamp rods 21. Respective cylinders 22 are disposed on the same axis center as the self-rotating axis center O2 of the work holding jig 10 respectively, and fixed to a bracket which is secured to an upper surface of the index table 6, so that these cylinders are rotated together with the work holding jigs 10 around the table rotating axis center O1 by the turning motion of the index table 6.

Figure 2:
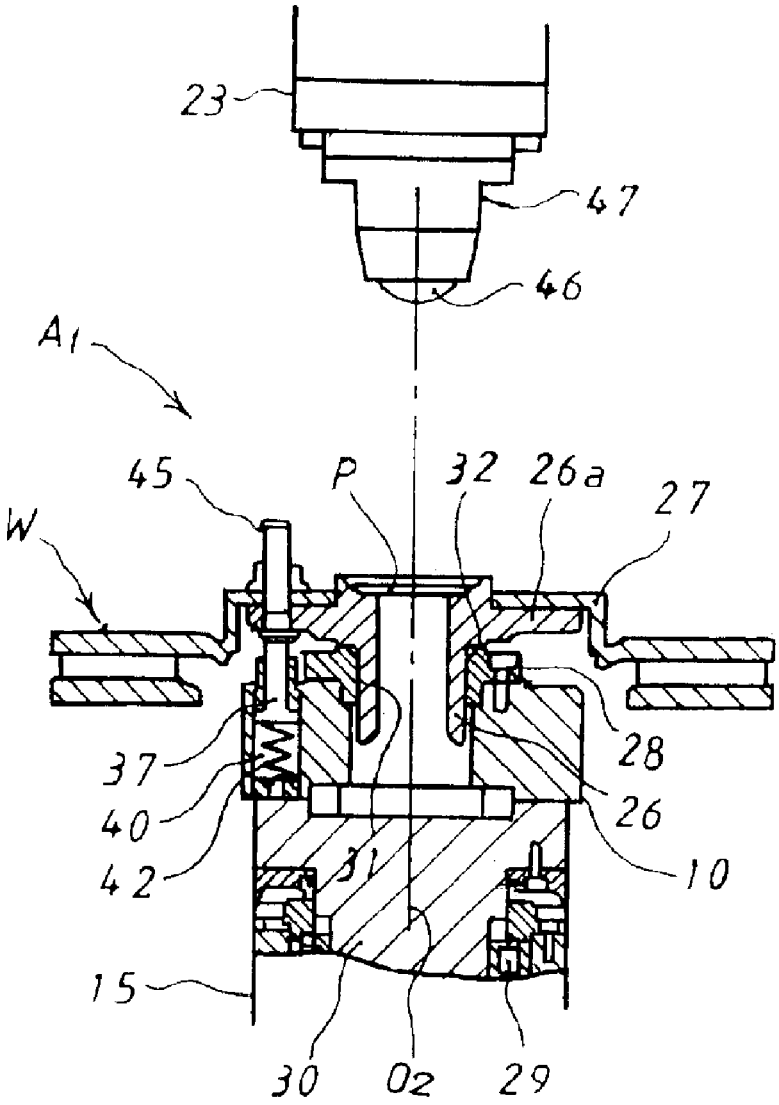
FIG. 2 is a vertical sectional view of a work holding jig and a work at a detaching position.

FIG. 2 is the enlarged vertical sectional view of the work holding jig 10 and the work W at the detaching position A1. The work comprises a disc brake for a vehicle, and is composed of a hub 26 integrally having a flange 26*a* and an annular disc 27 secured to the flange 26*a*. Both upper and lower end faces of the disc 27 is subjected to the surface grinding operation.

A self-rotating shaft 30 is supported rotatably in a jig support case 15 though a bearing 29. The work holding jig 10 is secured to an upper end face of the self-rotating shaft 30 on the same axis center as the self-rotating axis center O2. The bottom end of the self-rotating shaft 30 is connected and linked to a drive motor through a not-shown gear transmission mechanism.

The work holding jig 10 is formed into an annular shape. An annular positioning piece 28 is fixed on top of the jig 10 in a coaxial manner. An annular work reference surface 32, with which a lower surface of the flange 26*a* of the work W contacts, is formed protrusively toward upside. An inner peripheral surface 31 of the positioning piece 28 is set to a size fitting with the hub 26 of the work W. The work holding jig 10 is provided with an upward projecting stop pin 37 for restricting a rotating movement of the work W relative to the work holding jig 10. The stop pin 37 is inserted into a rod insertion hole 40 formed on the work holding jig 10 in such a manner as movable in vertical direction and urged toward upside by a spring 42, so as to stop the rotating movement of the work W relative to the work holding jig 10 when its upper end portion engages with a fitting bolt 45 or the flange 26*a* of the work W.

Figure 3:
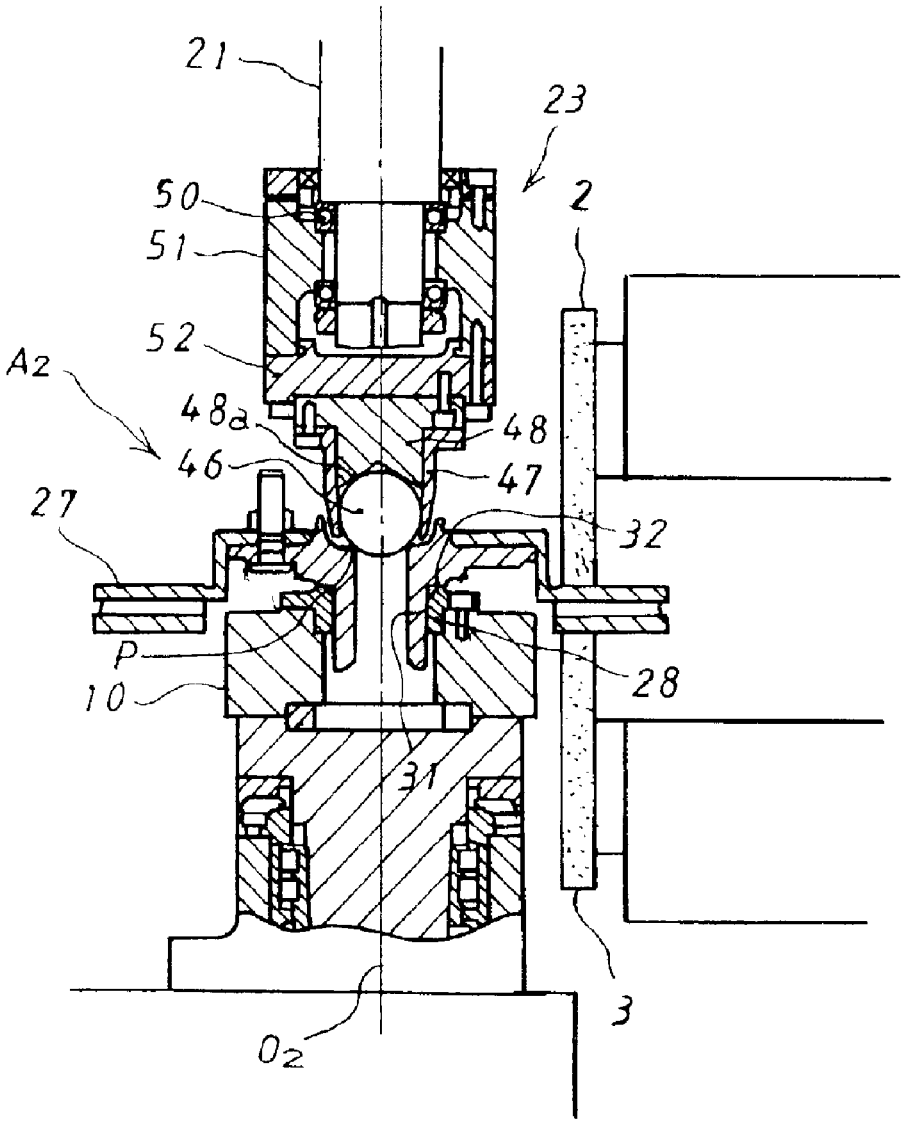
FIG. 3 is a vertical sectional view of a work holding jig, a work and a clamp unit at a grinding position.

FIG. 3 is the enlarged vertical sectional view of the clamp unit 23 and the work holding jig 10 at the grinding position A2. The clamp unit 23 is equipped with a steel ball 46 which contacts with a peripheral edge of a central hole of the work W from upside, a ball retaining cylinder 47 which fits with and supports the steel ball 46 protrusively toward downside, a ball cap 48 which has a conical receiving recessed face 48*a* contacting with an upper face of the steel ball 46, a bearing holder 51 which is supported rotatably around the self-rotating axis center O2 through the bearing 50 by the bottom portion of the clamp rod 21, and a lower cover 52 which is secured to a lower surface of the bearing holder 51. The steel ball 46, the ball retaining cylinder 47, the ball cap 48 and the bearing holder 51 are all arranged on the same axis center as the self-rotating center O2 of the work holding jig 10.

An inner peripheral surface of a lower half of the ball retaining cylinder 47 is formed into a small-diameter tapered shape at its lower part. The steel ball 46 is held by said tapered portion in a manner as protrusively toward downside. The ball cap 48 fits in the ball cylinder 47 from upside. The steel ball 46 is connected to the lower cover 52 together with the ball retaining cylinder 47 in a manner a protrusive toward downside.

(Function)

In FIG. 1, paying attention to an operation at the detaching position A1; the clamp unit 23 is moved upward, the work W is placed on the work holding jig 10, and the clamp rod 21 is moved downward, thereby the clamp unit 23 is clamped onto an upper central position of the work W.

In FIG. 2, at the time of loading the work, the hub 26 of the work W fits in the inner peripheral surface 31 of the positioning piece 28, a lower face of the flange 26*a* contacts with the annular reference receiving surface 32 of the positioning piece 28, and the stop pin 37 is positioned at a location deviated from the fitting bolt 45 in a peripheral direction. When the clamp unit 23 is moved downward under this state, the steel ball 23 contacts forcedly with a top edge P of an inner peripheral face (central hole) of the hub 26, so that the work W is positioned at a predetermined position as illustrated in FIG. 3.

Since a portion pressurized by the steel ball 46 is limited within the reference receiving surface 32, the work is positioned stably and correctly when it is clamped.

After completion of the clamping operation at the detaching position A1 of FIG. 1, the operating position is changed to the grinding position A2 when the index table 6 is moved by a half-turn.

In FIG. 3, the grinding wheels 2 & 3 are retracted upward and downward respectively during the position changing operation. After completion of the position changing operation, the work holding jig 10 is self rotated to cause rotation of the work W around the self-rotating axis center O2 and a distance between the upper and lower grinding wheels 2 & 3 is decreased, thereby the upper and lower end faces are simultaneously subjected to the surface grinding.

The steel ball 46 is also rotated together with the work W around the self-rotating axis center O2 during the grinding operation, however, the entire of the clamp unit 23 is rotated around the self-rotating axis center O2 relative to the clamp rod 21 because the clamp unit 23 is supported against the clamp rod 21 through the bearing 50. In other words, a slippage does not occur between the steel ball 46 and the work W so that a slippage does not occur between the steel ball 46 and the conical receiving face 48*a* too. Therefore, a worn-out of the steel ball 46 is controlled.

Since the work W is stopped in its rotation relative to the work holding jig 10 by the stop pin 45, there is no possibility of rotation of the work W relative to the work holding jig 10 caused by a grinding resistance.

After completion of the grinding operation of the work W, the upper and lower grinding wheels 2 & 3 are retracted from the upper and lower end faces of the work W upward and downward respectively. The self rotation of the work holding jig 17 is stopped, and the position is changed to the detaching position A1 of FIG. 1 by the half turn of the index table 6. Then, the clamp unit 23 is moved upward.

Other Embodiment (1) In place of the elevator actuator utilizing the cylinder having the clamp rod of FIG. 1, another actuators of pinion rack type and rocking lever type etc. utilizing motors for their power sources may be used.

What is claimed is:

1. A vertical type of double disc surface grinding machine for a work like a brake disc, having a pair of upper and lower grinding wheels rotating around a perpendicular axis center, a work holding jig which holds a work at a specified position and is self rotatable, and a clamp device which clamps the work onto the work holding jig, and enabling a simultaneous surface grinding of both upper and lower end surfaces by inserting the work held by the work holding jig in between the both grinding wheels;

in which the clamp device is equipped with a clamp unit freely rotatable around a self rotating axis center of the work holding unit through a bearing onto an elevator member of an elevator actuator, and the clamp unit is equipped with a steel ball contacting with a central concave portion of a work upper surface.

2. A vertical type of double disc surface grinding machine as set forth in claim 1, in which the steel ball is so inserted in a ball retaining cylinder as to be protruding downward and fixed from above by a conical receiving recessed surface of a ball cap member attached to the ball retaining cylinder in a detachable manner.

3. A vertical type of double disc surface grinding machine as set forth in claim 1 or claim 2, in which a stop member engaging with a part of the work to restrict a rotating motion of the work relative to the work holding jig is installed on an upper surface of the work holding jig.

* * * * *